US005593097A

United States Patent [19]

Corbin

[11] Patent Number: 5,593,097

[45] Date of Patent: Jan. 14, 1997

[54] MICRO MEDIA MILL AND METHOD OF ITS USE

[75] Inventor: Douglas D. Corbin, Rochester, N.Y.

[73] Assignee: Eastman Kodak Company, Rochester, N.Y.

[21] Appl. No.: 258,010

[22] Filed: Jun. 10, 1994

[51] Int. Cl.[6] ..... B02C 17/16; B02C 17/20

[52] U.S. Cl. ..... 241/21; 241/46.17; 241/170; 241/199.12

[58] Field of Search ..... 241/21, 46.17, 241/170, 199.12, 23

[56] References Cited

U.S. PATENT DOCUMENTS

| | | | |
|---|---|---|---|
| 2,764,359 | 9/1956 | Szegvari . | |
| 3,309,030 | 3/1967 | Molls et al. | 241/170 |
| 3,332,628 | 7/1967 | Wadham . | |
| 3,450,356 | 6/1969 | Szegvari . | |
| 3,601,322 | 8/1971 | Szegvari | 241/46 |
| 3,612,419 | 10/1971 | Szegvari | 241/172 |
| 3,726,487 | 4/1973 | Fraser | 241/46.17 |
| 3,773,468 | 11/1973 | Hubbard et al. | 241/199.11 X |
| 3,937,406 | 2/1976 | Klimaschka | 241/46.11 |
| 3,998,938 | 12/1976 | Szegvari | 423/594 |
| 4,303,205 | 12/1981 | Geiger et al. | 241/17 |
| 4,394,981 | 7/1983 | Schold | 241/46.17 |
| 4,496,106 | 1/1985 | Gross | 241/46.17 |
| 4,905,915 | 3/1990 | Ikebuchi et al. | 241/21 |
| 5,024,387 | 6/1991 | Yeh | 241/21 |

FOREIGN PATENT DOCUMENTS

| | | |
|---|---|---|
| 0173151 | 3/1986 | European Pat. Off. . |
| 0476189 | 3/1992 | European Pat. Off. . |
| 0483808 | 5/1992 | European Pat. Off. . |
| 71/06718 | 2/1971 | Japan . |
| 1344-409 | 10/1987 | U.S.S.R. . |
| 900050 | 7/1962 | United Kingdom . |
| 1310222 | 3/1973 | United Kingdom . |
| 1357251 | 6/1974 | United Kingdom . |

*Primary Examiner*—John M. Husar
*Attorney, Agent, or Firm*—Paul A. Leipold

[57] ABSTRACT

The invention provides apparatus for grinding comprising a generally cylindrical vessel containing grinding media, extending into said cylindrical vessel an agitator rotatable about its shaft and having pegs extending generally perpendicular to said shaft wherein said pegs extend within about 1 to about 3 mm of said vessel and wherein the diameter of said vessel is between about 10 and about 20 mm.

40 Claims, 4 Drawing Sheets

MICRO MEDIA MILL AND METHOD OF ITS USE

FIELD OF THE INVENTION

The invention relates to a method and apparatus for grinding particulate solids. In a preferred form, it relates to grinding such materials in a media and liquid.

BACKGROUND OF THE INVENTION

It is known that particulate matter may be ground to a finer size by the use of a media mill which incorporates fine particles that, during stirring with an agitating device, reduce the size of the material to be ground. Such grinding devices have been shown in Japanese 46/6718—Tokai Kinzoku Kogyo Co., Ltd. and U.S. Pat. No. 4,303,205—Geiger et al.

Also known are devices such as in U.S. Pat. No. 3,998, 938 which recirculate material through a media mill.

It is also known to use agitating means that have disks rather than arms in a media mill, such as disclosed in U.S. Pat. No. 3,601,322—Szegvari.

PROBLEM TO BE SOLVED BY THE INVENTION

While the previous media mills have been satisfactory, in many ways there remains a difficulty in the grinding of small amounts of particulate material to very fine sizes. The previous mills required large amounts of the material to be ground, and the previous mills did not function adequately if miniaturized. Further, previous media mills were large in size and expensive. Therefore, in order to do a multiplicity of samples, the operation of a single mill was not adequate given the long grinding times, and the cost of multiple mills was prohibitive.

SUMMARY OF THE INVENTION

It is an object of the invention to overcome disadvantages of prior apparatus process for media milling.

It is an object of the invention to allow the media milling of small quantities of material to a very fine size.

It is another object of the invention to provide a low cost apparatus and method for milling of small samples. These and other objects of the invention are generally accomplished by providing apparatus for grinding comprising a generally cylindrical vessel containing grinding media, extending into said cylindrical vessel an agitator rotatable about its shaft and having pegs extending generally perpendicular to said shaft wherein said pegs extend within about 1 to about 3 mm of said vessel sides and wherein the diameter of said vessel is between about 10 and about 20 mm.

In another embodiment of the invention, there is provided a method of grinding comprising a generally cylindrical vessel containing grinding media, extending into said vessel an agitator rotatable about its shaft and having pegs extending generally perpendicular to said shaft wherein said pegs extend within about 1 to about 3 mm of said cylinder and wherein the diameter of said vessel is between about 10 and about 20 mm, placing said agitator into said grinding media such that the uppermost peg is generally at the upper level of the media, adding vehicle liquid, adding the material to be ground, and agitating said media and said material by rotation of said agitator.

ADVANTAGEOUS EFFECT OF THE INVENTION

The invention provides an apparatus and method for media grinding of small lots of material and allows a high percentage of recovery of the material after grinding and separation from the media.

DETAILED DESCRIPTION OF THE INVENTION

The invention has numerous advantages over prior processes and apparatus. The process and apparatus of the invention provide a method of grinding materials that are only available in small quantities. Further, the grinding results in materials that may be recovered at a high percentage rate from the media. The invention also has the advantage that it can be performed at low cost utilizing low cost equipment. This allows multiple units to be utilized to test the large number of material samples at the same time. Further, the small size of the mixer of the invention makes it easier to mill in non-ambient atmospheres such as nitrogen and allows the use of disposable vessels minimizing need for washing and also the possibility of contamination. These and other advantages of the invention will be apparent from the description below.

Figure 3:
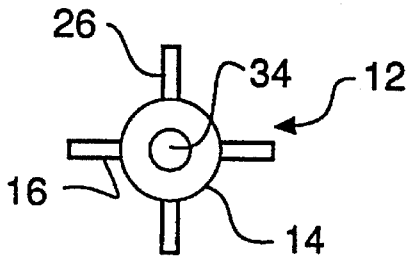
FIGS. 1, 2, and 3 are views of an agitator utilized in the apparatus and process of the invention.
Figure 1:
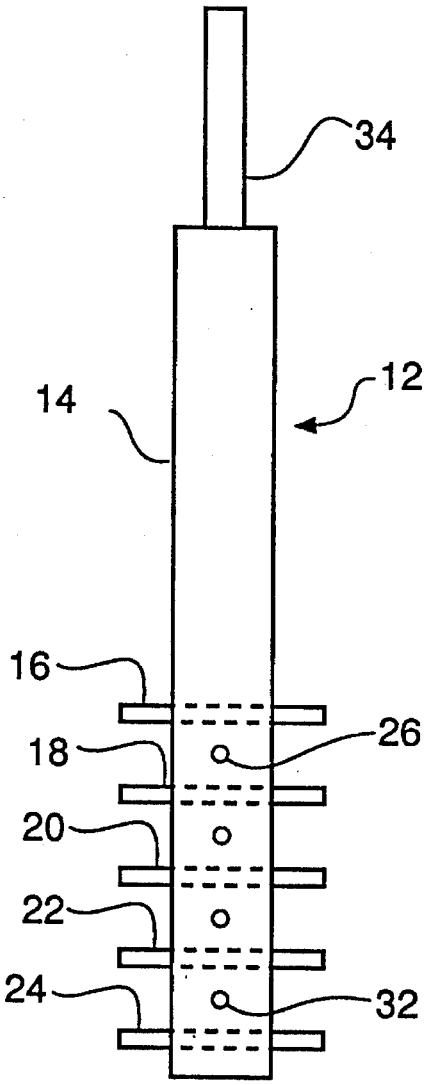
Figure 2:
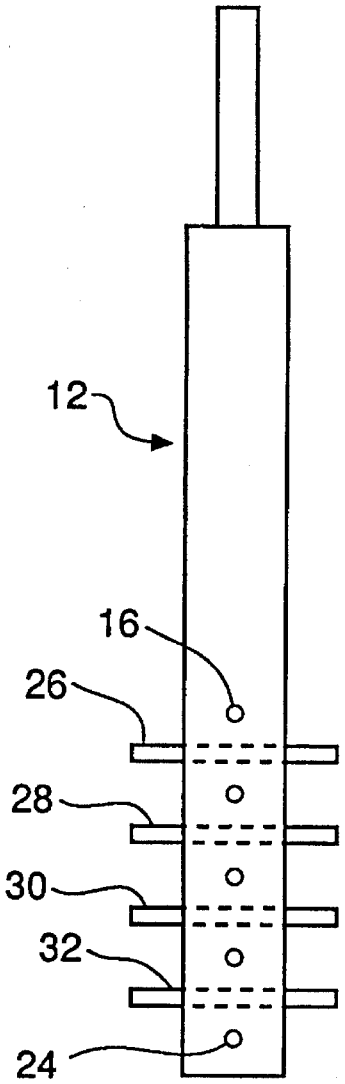

FIGS. 1, 2, and 3 are views of the agitator 12 utilized in the apparatus and process of the invention. The agitator 12 comprises a barrel 14 through which pins 16, 18, 20, 22, 24, 26, 28, 30, and 32 are placed at generally right angles to each other. The agitator 12 is provided with a reduced diameter section 34 that is designed to fit into a driving means for the agitator 12.

Figure 4:
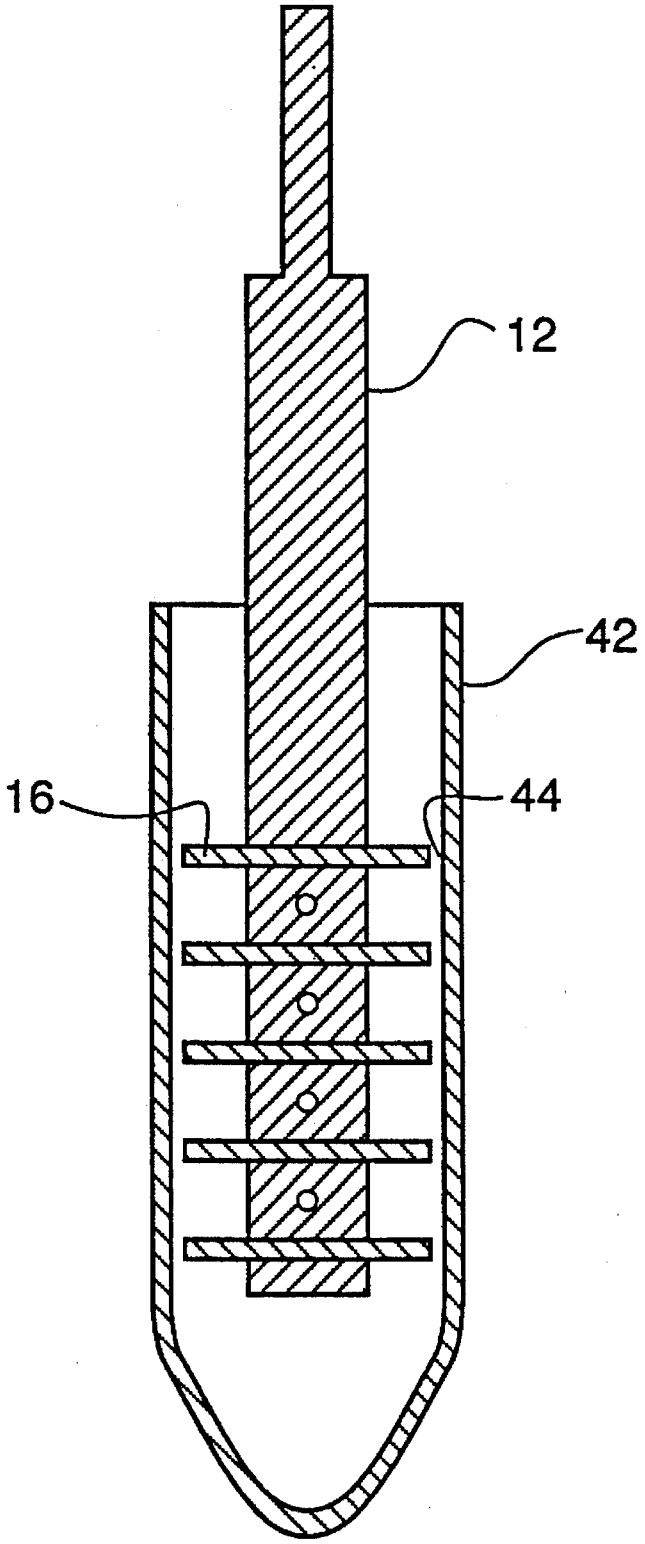
FIG. 4 is a cross-sectional view of the agitator of the invention in a mixing vessel.

As illustrated in the cross-sectional view of FIG. 4, the agitator 12 is placed into a vessel 42. The vessel closely corresponds to the pins of the agitator 12 such that it provides clearance 44 of between about 1 and about 3 mm at each end of the pins, such as 16. It is noted that the pins 16–32 are all of substantially equal length and are alternated at generally right angles to each other along the length of the stirrer 12.

Figure 5:
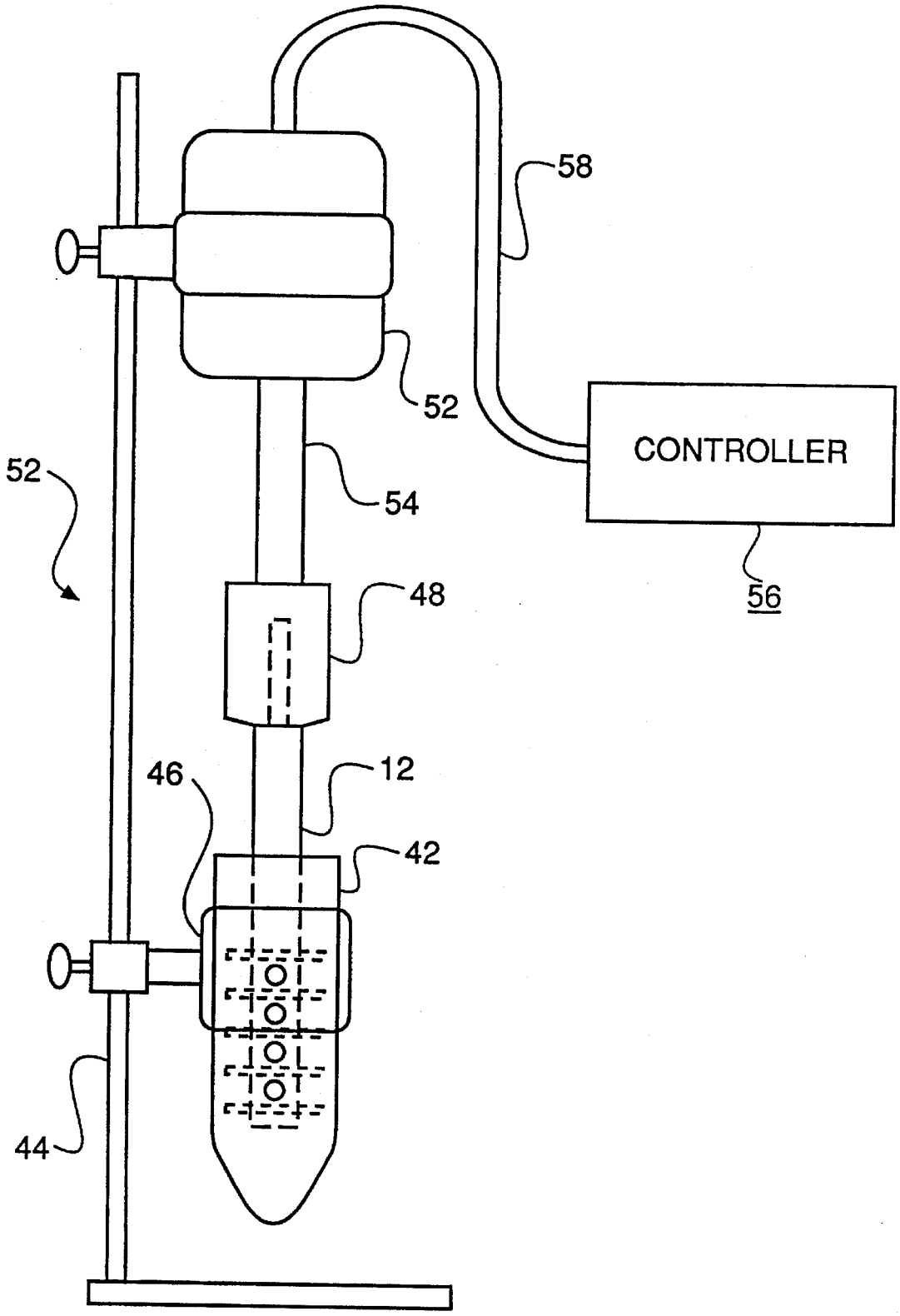
FIG. 5 is a view of the apparatus of the invention including the motor and representation of the controller.

In FIG. 5, apparatus 52 illustrates the apparatus of the invention in position for performing the process of the invention. As illustrated in apparatus 52, the vessel 42 is held in stand 44 by clamp 46. Chucking device 48 joins the agitating device 12 with the rotary drive means 52 through shaft 54. The speed of rotation controlled by the controller 56 joined to the rotary drive means 52 by cable 58. The controller allows the agitator 12 to be driven by the rotary drive means 52 at any desired speed and for any length of time to provide sufficient agitation of the material in vessel 42.

The agitator of the invention may be formed of any suitable material. Typically the material is a hard material that is non-contaminating of the material being treated by the media mill. Typical of such materials are stainless steel shafts with tungsten carbide pegs. It is also possible that the agitator may be coated with aluminum oxide or nylon. Further, it is possible that other materials, such as silicon carbide, could be utilized for the pegs or the shaft. It is also possible that the mixer could be formed from the polymer materials to minimize metal contamination. The vessels utilized in the mixing may be formed from any suitable material. Typically for the small quantities utilized in the invention, the vessels are low in cost and may be discarded after use. Typical of the materials suitable for the vessel of the invention are centrifuge tubes or other test tubes. These tubes may be formed from glass or a plastic, such as polyethylene. Further, the tubes may be formed of stainless steel or other metal, particularly if it is polymer coated. The utilization of disposable tubes eliminates the problem of contamination from one batch to the next, as well as the expensive washing. It is noted that the illustration in the drawing shows a V-bottom tube. However, it is possible that tubes with rounded bottoms could be used.

In performing the mixing of the invention, it has been found that the pegs extending from the agitator should extend to within between about 1 and about 3 mm of the sides of the vessel to provide the milling desired in the shortest possible time without damage to the materials and production of excessive heat. It is preferred that the diameter of the vessel be between 10 and about 20 mm on the interior dimension in order to allow milling of small batches with minimum waste and short time of treatment. The volume of the vessels utilized in the apparatus of the invention generally is between about 30 and 75 ml. A preferred volume is about 50 ml for the mixing of batches of material to be treated of between about 2 and about 15 ml.

The media suitable for the process of the invention is generally between about 1 and about 0.17 mm in diameter. It may be formed of any material that is not contaminating of the material being milled and that it is hard enough that it is not significantly abraided during the milling process. Preferred materials for medicinal compounds have been found to be zirconium oxide and glass.

Figure 6:
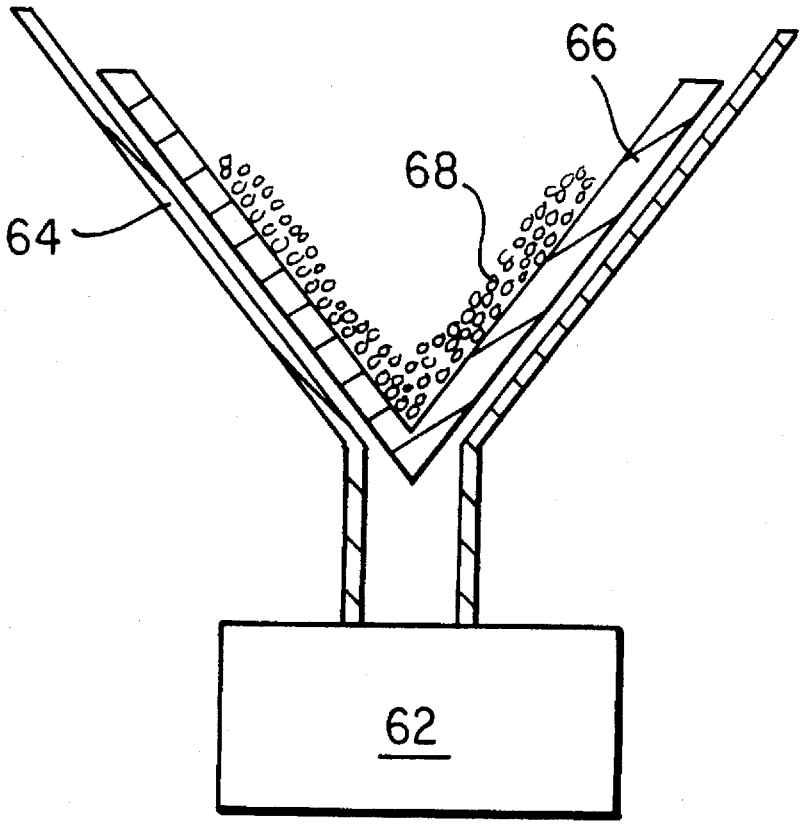
FIG. 6 represents a schematic view of a filtering means for use in the invention.

After the milling operation, the media is separated from the material milled by any suitable method. Typically the material is placed onto filter paper, and the material is separated by vacuum. Means for separation is illustrated in FIG. 6 where the funnel 64 has filter paper 66 therein. The funnel is connected to vacuum means 62 to draw fluid and milled material (not shown) from the media 68.

In operation of the media mill of the invention, it is generally advantageous if the top peg of the mixer illustrated as peg 16 is even with the top of the media to avoid splattering by vortexing of the material during mixing. If this practice is followed, no seal or cover is needed during mixing or agitation. A process of the invention allows grinding of materials of quantities as small as 0.25 grams. Also the process of the invention allows a smaller size of less than 0.5 micron average diameter to about 0.05 micron average diameter to be formed in about 60 minutes. In previous mills it was difficult to get below the about 1 micron size. The small mills of the process of the invention also allow the use of smaller media which contributes to the fine wet grinding with relatively uniform size distribution of the particles formed. Stirring speed of the agitator is generally up to about 2,500 rpm for rapid milling without damage to the material by excessive heat or shear. The apparatus of the invention further has the advantage that it is scaleable, such that when larger quantities of material are available, the time of mixing corresponds very well to larger mills such as a 4 liter mill.

The apparatus of the invention has a preferred top speed of the pegs of agitator of about 3 m/sec. This relatively slow speed of the tips reduces heat buildup even at the preferred speed of 2300 rpm.

In a preferred form, the agitator of the invention has pegs of about ⅞ inch (about 2.2 cm) length and ⅛ inch (about 0.3 cm) diameter mounted through an agitator shaft of about 0.5 inch (about 1.3 cm) diameter. The pegs may be held by adhesive. It is also possible to hold the pegs by other means such as welding, thermal sealing, or force fitting.

The process and apparatus of the invention finds particular advantage in the formation of medicinal compounds. Such compounds require many tests performed with different sizes and quantities of materials. Further, the materials to be milled often are expensive and are not suitable for high temperature exposure. Therefore, a low temperature method of milling very small quantities in a reproducible manner is desirable. The ability to mix small lots of small materials, such as a 5 cc sample containing 1 gram of material, is particularly desirable. The invention is particularly suitable for utilization in milling of drugs, food additives, catalysts, pigments, and scents.

The invention has been described as a milling device. It also may find use as a reactor by adding ingredients after sizing. Further, it would be possible to use it as a dry grinder for temperature resistant materials. It also could be used simply as a mixer for small quantities of materials.

The controller of the apparatus of the invention may be set up to measure the torque required for the mixing and, therefore, mixing can be controlled to a certain viscosity. By shut off at a certain torque, a viscosity may be reproduced. This advantage is not available in other media mills. Further, the mill of the invention may be combined with an ultrasonic cup at the bottom of the tube to provide more energy to the material being treated. These and other advantages will be apparent to one in the art, and they are intended to be encompassed by the invention that it is only intended to be limited by the claims attached hereto.

The invention has been described in detail with particular reference to preferred embodiments thereof, but it will be understood that variations and modifications can be effected within the spirit and scope of the invention.

I claim:

1. Apparatus for wet batch grinding of material comprising a generally cylindrical vessel containing grinding media, said vessel having a volume of between about 30 and 75 ml, extending into said cylindrical vessel an agitator rotatable about its shaft and having pegs extending generally perpendicular to said shaft wherein said pegs extend to within between about 1 and about 3 mm of the sides of said vessel and wherein vessel is between about 10 and about 20 mm, said vessel comprises a test tube, and said agitator consists of said shaft and said pegs.

2. The apparatus of claim 1 further comprising a drive means for said shaft.

3. The apparatus of claim 2 wherein said drive means has a variable speed up to about 2500 rpm.

4. The apparatus of claim 1 wherein said vessel comprises a glass tube.

5. The apparatus of claim 1 wherein said vessel has a capacity of about 50 ml.

6. The apparatus of claim 1 wherein said grinding media is between about 200 to about 1000 microns in diameter.

7. The apparatus of claim 6 wherein said media is about 350 microns in diameter.

8. The apparatus of claim 1 further comprising a temperature control bath around said vessel.

9. The apparatus of claim 1 wherein there are nine pegs.

10. The apparatus of claim 1 wherein said test tube comprises glass, plastic, or metal.

11. The apparatus of claim 1 wherein said vessel is open at the top.

12. The apparatus of claim 1 wherein said test tube has a smooth inner surface.

13. A method of wet batch grinding comprising providing a generally cylindrical vessel containing grinding media, said vessel having a volume of between about 30 and 75 ml, extending into said vessel an agitator rotatable about its shaft and having pegs extending generally perpendicular to said shaft wherein said pegs extend within about 1 to about 3 mm of said cylinder and wherein the diameter of said vessel is between about 10 and about 20 mm, placing said agitator into said grinding media such that the uppermost peg is generally at the upper level of the media, adding vehicle liquid, adding the material to be ground, and agitating said media and said material, by rotation of said agitator, with the proviso that said vessel comprises a test tube, and said agitator consists of said shaft and said pegs.

14. The method of claim 13 wherein the volume of said vehicle and said material is about 5 ml.

15. The method of claim 14 wherein said vessel has a volume of about 50 ml.

16. The method of claim 10 wherein said material to be ground is reduced to less than 0.5 micron average diameter in less than 60 min.

17. The method of claim 13 wherein after said grinding, said material and said vehicle are removed from said media by vacuum.

18. The method of claim 17 wherein after grinding, the vacuum removal recovers greater than 90 percent of said material.

19. The method of claim 16 wherein said material comprises a medicinal material.

20. The method of claim 13 wherein said material comprises up to about 4 grams of said material to be ground.

21. The method of claim 20 wherein the volume of the material to be ground is about 5 ml.

22. The method of claim 21 wherein said material to be ground is reduced to less than 0.5 micron average diameter in less than 60 min.

23. The method of claim 13 wherein said method utilizes a vessel that has a smooth inner surface.

24. Apparatus for wet batch grinding of material comprising a generally cylindrical vessel containing grinding media, said vessel having a volume of between about 30 and 75 ml, extending into said cylindrical vessel an agitator rotatable about its shaft and having pegs extending generally perpendicular to said shaft wherein said pegs extend to within between about 1 and about 3 mm of the sides of said vessel and wherein the diameter of said vessel is between about 10 and about 20 mm, said vessel comprises a centrifuge tube, and said agitator consists of said shaft and said pegs.

25. The apparatus of claim 24 wherein said vessel is a centrifuge tube that has a V-bottom and is open at the top.

26. The apparatus of claim 24 further comprising a drive means for said shaft.

27. The apparatus of claim 26 wherein said drive means has a variable speed up to about 2500 rpm.

28. The apparatus of claim 24 wherein said vessel comprises a glass tube.

29. The apparatus of claim 24 wherein said vessel has a capacity of about 50 mi.

30. The apparatus of claim 24 wherein said grinding media is between about 200 to about 1000 microns in diameter.

31. The apparatus of claim 24 wherein said vessel is open at the top.

32. The apparatus of claim 24 wherein said cylindrical tube has a smooth inner surface.

33. A method of wet batch grinding comprising providing a generally cylindrical vessel containing grinding media, said vessel having a volume of between about 30 and 75 ml, extending into said vessel an agitator rotatable about its shaft and having pegs extending generally perpendicular to said shaft wherein said pegs extend within about 1 to about 3 mm of said cylinder and wherein the diameter of said vessel is between about 10 and about 20 mm, placing said agitator into said grinding media such that the uppermost peg is generally at the upper level of the media, adding vehicle liquid, adding the material to be ground, and agitating said media and said material, by rotation of said agitator, with the proviso that said vessel comprises a centrifuge tube, and said agitator consists of said shaft and said pegs.

34. The method of claim 33 wherein the volume of said vehicle and said material is about 5 ml.

35. The method of claim 34 wherein said vessel has a volume of about 50 ml.

36. The method of claim 34 wherein said material comprises up to about 4 grams of said material to be ground.

37. The method of claim 33 wherein after said grinding, said material and said vehicle are removed from said media by vacuum.

38. The method of claim 33 wherein said material to be ground is reduced to less than 0.5 micron average diameter in less than 60 min.

39. The method of claim 33 wherein said material comprises a medicinal material.

40. The method of claim 33 wherein said centrifugal tube has a smooth inner surface.

* * * * *